United States Patent [19]

Hoare

[11] Patent Number: 4,968,958

[45] Date of Patent: Nov. 6, 1990

[54] BROAD BANDWIDTH PLANAR POWER COMBINER/DIVIDER DEVICE

[75] Inventor: Percy W. Hoare, Hassocks, England

[73] Assignee: U.S. Philips Corporation, New York, N.Y.

[21] Appl. No.: 397,056

[22] Filed: Aug. 22, 1989

[30] Foreign Application Priority Data

Aug. 31, 1988 [GB] United Kingdom ..... 8820554

[51] Int. Cl.[5] ..... H01P 5/12

[52] U.S. Cl. ..... 333/128; 333/34

[58] Field of Search ..... 333/128, 136, 34

[56] References Cited

U.S. PATENT DOCUMENTS

| | | | |
|---|---|---|---|
| 2,836,798 | 5/1958 | Le Vine | 333/128 |
| 2,877,427 | 3/1959 | Butler | 333/128 |
| 3,646,478 | 2/1972 | Ross | 307/106 |
| 4,129,839 | 12/1978 | Galani et al. | 333/128 |
| 4,835,496 | 5/1989 | Schellenberg | 333/128 |

OTHER PUBLICATIONS

W. Yau et al., "An N—Way Broadband Planar Power Combiner/Divider", Microwave Journal, vol. 29, No. 11, Nov. 1986, pp. 147–151.

M. Hamadallah, "Microstrip Power Dividers at mm—Wave Frequencies", Microwave Journal, vol. 31, No. 7, Jul. 1988, pp. 115–127.

I. Wolf, "Computer Aided Design of Microstrip Power Dividers", Proceedings of the 1973 European Microwave Conference, Brussels, Sep. 4–7, 1973, pp. A.12.5.

*Primary Examiner*—Paul Gensler

*Attorney, Agent, or Firm*—Jack D. Slobod

[57] ABSTRACT

A planar power combiner/divider device comprises a metallic layer on an insulating substrate. The metallic layer is configured to have an output (input) neck portion (12) which extends into a purely tapered portion (16) which in turn splits into n tapering conductors (1 to 5), the terminal portions of which constitute input (output) ports. The overall length (L) of the metallic layer between a junction (14) of the neck and purely tapering portions to each input (output) port being substantially constant and equal to substantially half the wavelength of the lowest design frequency and the distance x from the junction (14) to the (first) split into tapering conductors is selected so as to avoid transverse resonance at the desired frequencies.

7 Claims, 2 Drawing Sheets

BROAD BANDWIDTH PLANAR POWER COMBINER/DIVIDER DEVICE

BACKGROUND OF THE INVENTION

1. Field of the Invention

The present invention relates to broad bandwidth planar power combiner/divider device.

2. Description of the Related Art

FIG. 1 of the accompanying drawing illustrates a power combiner/divider device 10 as described by W. Yau and J. M. Schellenberg in an article entitled "An N-Way Broadband Planar Power Combiner/Divider" published by Microwave Journal, Vol. 29, No. 11 November 1986, pages 147 to 151 (See also U.S. Pat. No. 4,835,496 issued May 30, 1989). The device 10 utilizes the Dolph-Chebyshev tapered transmission line and comprises a five-way power combiner/divider for operating between 2 and 18 GHz. The device comprises a quartz substrate on which are provided five tapering conductors 1 to 5 which merge into one central conductor 12 substantially at a junction 14 with the central conductor. The gap spacings between adjacent conductors 1 to 5 are identical and are relatively small (0.038 mm) to ensure that the coupled structure conformed to the Dolph-Chebyshev tapered line condition. An isolation network formed of chip resistors R connects between the tapering conductors 1 to 5 and help to give a broadband performance. This type of combiner/divider device provides an impedance transformation of N times 50 ohms distributed ports to one 50 ohm central port Choosing the Dolph-Chebyshev taper has the feature that it has minimum reflection coefficient magnitude in the passband for the specified length of taper or conversely for a specified maximum magnitude reflection coefficient in the passband, the Dolph-Chebyshev taper has a minimum length. The contour and the length of the taper determine the in-band reflection coefficient and the lower cut-off frequency, respectively.

This known design of planar power combiner/divider can have a number of drawbacks. One of these is that the device can have a distinct resonance frequency caused by the transverse resonance mode supported by the cross-section of the tapered transmission line. Another of these drawbacks can be that the chip resistors R are difficult to connect to the conductors 1 to 5 and also they generally do not give their anticipated performance due to inductive and capacitive parasitic effects.

SUMMARY OF THE INVENTION

An object of the present invention is to overcome these drawbacks.

According to the present invention there is provided a planar power combiner/divider device comprising an electrically conductive layer on an insulating substrate, the metallic layer being configured to form an output (input) port and at least two input (output) ports, the metallic layer tapering laterally outwardly from the output (input) port and splitting into at least two tapering conductors whose terminal ends form respective input (output) ports, wherein the point at which the layer splits into the at least two tapering conductors is chosen to avoid transverse resonance at desired frequencies and has an impedance less than that at the output (input) port.

The planar power combiner/divider device made in accordance with the present invention provides a compact device which provides a trade-off between output VSWR, transverse resonance and realizability.

If desired each of the tapering conductors may split into further tapering conductors thus enabling a multistage power combiner/divider to be fabricated.

At least those tapering conductors whose terminal ends form the input (output) ports may branch away from each other thus improving the electrical isolation between them.

In an embodiment of the present invention, proceeding from the output (input) port, the metallic layer comprises a neck portion leading to a pure taper portion which extends to the, or the first, split into the at least two tapering conductors. The length (L) of the metallic layer from a junction of the neck and pure taper portions to each of the input (output) ports is substantially constant. The length (L) equals half the wavelength of the lowest design frequency. The device is constructed to operate in an even mode impedance.

BRIEF DESCRIPTION OF THE DRAWING

The present invention will now be explained and described, by way of example, with reference to the accompanying drawings, wherein.

DETAILED DESCRIPTION OF THE PREFERRED EMBODIMENTS

Figure 1:
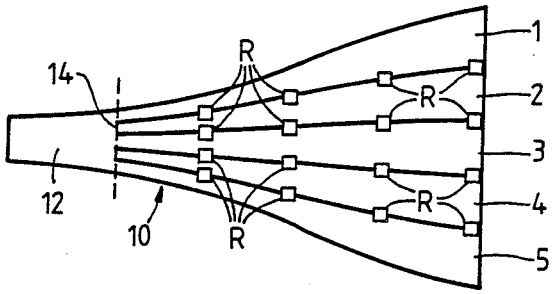
Fig. 1. PRIOR ART
FIG. 1 is a diagrammatic plan view of the known planar power combiner/divider device described in the introductory portion of the present specification.

In the drawings the same reference numerals have been used to indicate corresponding features. For convenience of description the illustrated devices will be described in terms of a power divider in which input power is applied to the central conductor 12. A power combiner will operate in the opposite direction but the output voltage standing wave ratio (VSWR) may be degraded.

Figure 2:
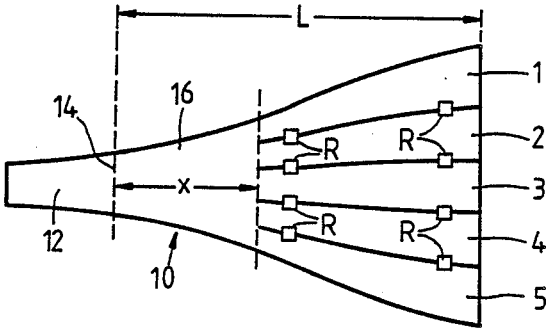
FIG. 2 is a diagrammatic plan view of a planar power combiner/divider device in which a junction of the five tapering conductors and the central conductor is at a distance x from the location of the junction 14 in the device shown in FIG. 1.
Figure 3:
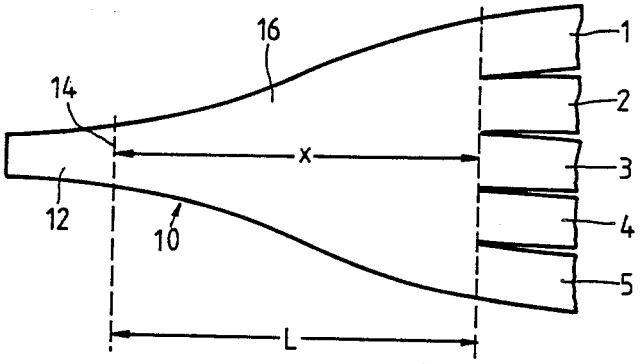
FIG. 3 is a diagrammatic plan view of a planar power combiner/divider device in which the five output conductors are coupled to the wider end of Dolph-Chebyshev taper with no resistors between adjacent output conductors.

FIGS. 2 and 3 of the drawings facilitate the understanding of the present invention by explaining the factors which have to be considered when moving the point of merging of the tapering conductors 1 to 5 by a distance x from the point 14. The distance from the point 14 to the wider end of the taper is indicated by the letter L. The choice of the length L is equal to half the wavelength of the lowest design frequency.

With a good power divider the input and output VSWRs should be well matched. If a compromise has to be made then it is preferred that one has a good input VSWR, a good performance having regard to avoiding discontinuities which give rise to parasitics and a reduction in processing difficulties.

FIG. 2 illustrates the situation in which the overall shape of the device 10 conforms to a Dolph-Chebyshev taper but instead of the tapered conductors 1 to 5 merging with the central conductor 12 at the point 14 at which the impedance of the central conductor 12 is beginning to change, the point of merging is displaced by a distance x from the point 14. In determining the distance x, one endeavours to maintain the input VSWR by ensuring that the impedance at each position on the widening tapered portion 16, which for convenience of description will be referred to as "pure taper", conforms to a defined function related to the distance from the input end of the central conductor 12. An isolation network comprising resistors R is required. However as there are fewer resistors R the manufacturing problems are eased.

FIG. 3 illustrates the case where the length x of the pure taper has been made equal to L and the tapering output conductors 1 to 5 are connected to the wider end of the device 10. No resistors are connected between the output conductors. This arrangement represents a limiting case where the device 10 constitutes an impedance transformer. The increasing width of the pure taper causes resonance problems. Additionally the greater the value of x the worse the output VSWR becomes and the output isolation between the conductors is not good.

On the basis that the devices shown in FIGS. 1 and 3 represent the opposite limiting cases, the devices made in accordance with the present invention represent a new approach by having a pure taper portion having a length x which then divides into a number of tapering conductors which branch away from each other to provide good isolation. The overall length from the point 14 to the terminal end of each of the conductors is L. The width of the terminal end of each of the conductors is determined to provide the desired impedance.

Figure 4:
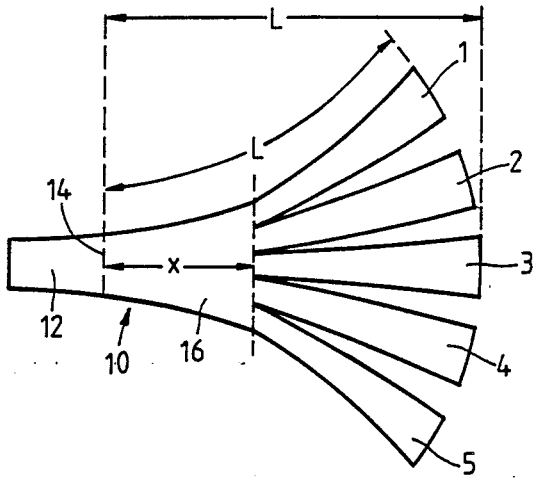
FIG. 4 is a diagrammatic plan view of an embodiment of a planar power combiner/divider made in accordance with the present invention.

FIG. 4 illustrates an embodiment of a planar power divider made in accordance with the present invention. The input impedance Z(i) of the central conductor 12 is 50 ohms and the width of the terminal ends of the tapering conductors 1 to 5 is such as to provide a 50 ohm output impedance (Z(o)). The length x of the pure taper 16 is governed by physical constraints. The widths and spacings of the tapering conductors 1 to 5 are determined by having a correct even mode impedance at each point.

Figure 5:
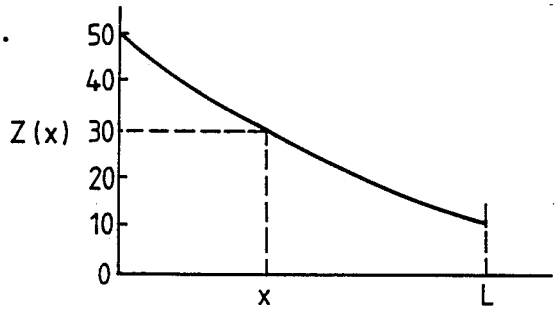
FIG. 5 is a graph of impedance Z versus distance from the junction 14.

The length x is chosen such that there are no resonances over the desired frequency range and that the impedance Z(x) at that point is determined by the equation $$Z(x) = Z(o)\exp\left[\frac{x\ln 1/n}{L}\right]$$

where n is the number of tapering conductors. A graph of Z(x) versus length for a specimen taper is shown in FIG. 5. By selecting a particular value for Z(x), for example 30 ohms, then the value of x can be determined. The input impedance to each of the tapering conductors is n times Z(x), in this illustrated example the input impedance will be 5×30 ohms, that is 150 ohms. The tapering of each of the conductors 1 to 5 has to be designed such that the impedance goes from 150 ohms to 50 ohms over the length (L-x).

In a non-illustrated embodiment of the present invention it is possible to arrange an unequal power division by modifying the widths and spacings of the tapered conductors so that they have different input and output characteristic impedances, regard being paid to the fact that the even mode impedances must be correct.

Figure 6:
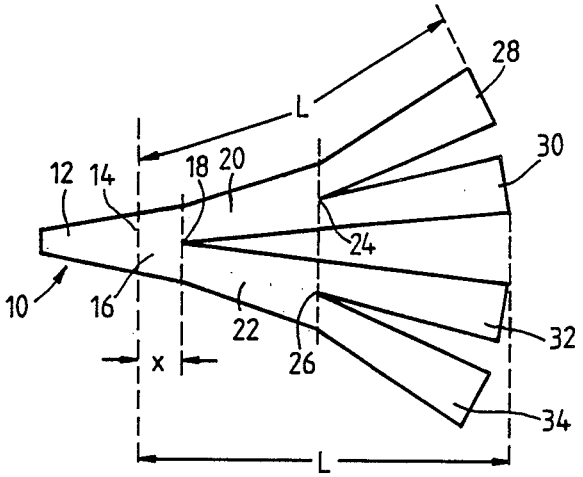
FIG. 6 is a diagrammatic plan view of another embodiment of a planar power combiner/divider made in accordance with the present invention.

FIG. 6 illustrates another embodiment of the present invention in which input power is divided by 4 in two stages, the overall length of which is L. The pure taper 16 is split at 18 to form two tapering conductors 20, 22 which are respectively split at 24, 26 to form pairs of tapering conductors 28, 30 and 32, 34. The determination of x and the profiles of the tapering conductors 20, 22, 28, 30, 32 and 34 are made having regard to the criteria mentioned above.

Power dividers of the type generally shown in FIG. 6 can be configured differently to obtain a desired split, for example the conductor 22 may split into three rather than two as shown. Also the power division may take place over more than two stages provided that their overall combined length does not exceed L.

Planar power combiners/dividers made in accordance with the present invention can be fabricated in any suitable medium because one is working in even mode impedance. Fabrication can be effected by using microstrip methods. Resistors are not required between the tapering conductors.

I claim:

1. A planar power combiner/divider device comprising an electrically conductive layer on an insulating substrate, which layer proceeds from an output (input) port to at least two input (output) ports; wherein, proceeding from said output (input) port, said layer comprises a neck portion leading into a pure laterally outward taper portion which extends to a point at which the layer splits laterally into at least two laterally outward tapering conductors having terminal ends at said at least two input (output) ports, the length (L) of the conductive layer from the junction of the neck and pure taper portions to each of said at least two input (output) ports being substantially equal to half the wavelength of the lowest design frequency.

2. A device as claimed in claim 1, wherein at least one of the tapering conductors splits laterally into at least two further laterally outward tapering conductors.

3. A device as claimed in claim 2, wherein said at least two tapering conductors branch away laterally from each other.

4. A device as claimed in claim 3, wherein said device is constructed to operate in an even mode impedance.

5. A device as claimed in claim 1, wherein said at least two tapering conductors branch laterally away from each other.

6. A device as claimed in claim 5, wherein said device is constructed to operate in an even mode impedance.

7. A device as claimed in claim 1, wherein said device is constructed to operate in an even mode impedance.

* * * * *